US009769909B2

(12) United States Patent
Gershowitz et al.

(10) Patent No.: US 9,769,909 B2
(45) Date of Patent: Sep. 19, 2017

(54) CURRENT STEERING AND DIMMING CONTROL OF A LIGHT EMITTER

(71) Applicant: XENIO CORPORATION, San Francisco, CA (US)

(72) Inventors: Michael N. Gershowitz, San Jose, CA (US); Jesus Del Castillo, Livermore, CA (US)

(73) Assignee: XENIO CORPORATION, San Francisco, CA (US)

( * ) Notice: Subject to any disclaimer, the term of this patent is extended or adjusted under 35 U.S.C. 154(b) by 15 days.

(21) Appl. No.: 14/562,639

(22) Filed: Dec. 5, 2014

(65) Prior Publication Data

US 2016/0165692 A1 Jun. 9, 2016

(51) Int. Cl.
*H05B 37/02* (2006.01)
*H05B 33/08* (2006.01)

(52) U.S. Cl.
CPC ..... *H05B 37/0272* (2013.01); *H05B 33/0803* (2013.01); *H05B 33/0857* (2013.01)

(58) Field of Classification Search
CPC ..... H05B 33/083; H05B 33/0833; H05B 33/0803; H05B 33/0815; H05B 37/0272; H05B 41/2828; H05B 41/2228; H05B 33/0845; H05B 33/0824; H05B 33/0857; H05B 37/02; Y02B 20/146
USPC ..... 315/149, 291, 307, 224, 246, 312, 158, 315/287; 323/212, 300
See application file for complete search history.

(56) References Cited

U.S. PATENT DOCUMENTS

| | | | | |
|---|---|---|---|---|
| 7,002,546 | B1 * | 2/2006 | Stuppi | G09G 3/3413 345/102 |
| 8,035,313 | B2 * | 10/2011 | Wendt | H05B 33/0818 315/169.3 |
| 8,222,825 | B2 * | 7/2012 | Kang | H05B 33/0851 315/209 R |
| 8,531,136 | B2 * | 9/2013 | Grajcar | H05B 33/0827 315/194 |
| 8,569,974 | B2 * | 10/2013 | Chobot | H05B 33/0866 315/149 |
| 8,872,438 | B2 * | 10/2014 | Zhou | H05B 33/0845 315/193 |
| 9,155,171 | B1 * | 10/2015 | Hughes | H05B 37/02 |
| 9,456,486 | B2 * | 9/2016 | Datta | H05B 33/0815 |
| 2014/0159579 | A1 * | 6/2014 | Seol | H05B 33/0809 315/85 |
| 2015/0173133 | A1 * | 6/2015 | Seki | H05B 33/08 315/185 R |

* cited by examiner

*Primary Examiner* — Haissa Philogene
(74) *Attorney, Agent, or Firm* — Arent Fox LLP

(57) ABSTRACT

A lighting module includes a light emitting diode (LED) array and a dimming circuit configured to control current applied to the LED array to control luminance of light emitted from the lighting module.

17 Claims, 14 Drawing Sheets

VIEW OF TOP OF LAM/ICM ASSEMBLY
(PERSPECTIVE TOP VIEW)

VIEW OF TOP OF LAM/ICM ASSEMBLY
(PERSPECTIVE TOP VIEW)

VIEW OF BOTTOM OF LAM/ICM ASSEMBLY
(PERSPECTIVE VIEW)

TOP-DOWN VIEW OF LAM/ICM ASSEMBLY
(TOP-DOWN VIEW)

TOP-DOWN VIEW OF ONE EXAMPLE OF A LAM
(SHOWN WITHOUT PHOSPHOR LAYER)

THE LAM FITS UP INTO THE CENTRAL OPENING IN THE
BOTTOM OF THE ICM AND IS FIXED IN PLACE
(CROSS-SECTIONAL SIDE VIEW OF ASSEMBLY)

BOTTOM-UP VIEW OF ICM SHOWING CONTACT PADS ON THE INSIDE LIP OF THE ICM

DETAIL OF A CONTACT PAD OF THE LAM MAKING CONTACT WITH A CONTACT PAD ON THE BOTTOM OF THE INSIDE LIP OF THE ICM

CROSS-SECTIONAL VIEW TAKEN ALONG LINE A-A'
(SHOWN ON A HEAT SINK)

CROSS-SECTIONAL VIEW TAKEN ALONG LINE B-B'
(SHOWN ON A HEAT SINK)

CROSS-SECTIONAL VIEW TAKEN ALONG LINE C-C'
(SHOWN ON A HEAT SINK)

CROSS-SECTIONAL VIEW TAKEN ALONG LINE D-D'
(SHOWN ON A HEAT SINK)

CURRENT STEERING AND DIMMING CONTROL OF A LIGHT EMITTER

BACKGROUND

Field

The present disclosure relates generally to solid state light emitters, and more particularly, to dimming control of the solid state light emitter.

Background

Solid state light emitters, such as light emitting diodes (LEDs), are becoming the favored choice for general lighting applications over incandescent lamps and fluorescent fixtures for their lower power demand. An LED converts electrical energy to light. Light is emitted from active layers of semiconductor material sandwiched between oppositely doped layers when a voltage is applied across the doped layers. In order to use an LED chip, the chip is typically enclosed along with other LED chips in a package. In one example, the packaged device is referred to as an LED array. The LED array includes an array of LED chips mounted onto a heat conducting substrate. A layer of silicone in which phosphor particles is embedded is typically disposed over the LED chips. Electrical contact pads are provided for supplying current into the LED array and through the LED chips so that the LED chips can be made to emit light. Light emitted from the LED chips is absorbed by the phosphor particles, and is re-emitted by the phosphor particles so that the re-emitted light has a wider band of wavelengths.

Compact lighting fixtures or modules with solid state light emitters do not contain AC/DC conversion, DC driver, and dimming control circuits due to the heat generated by the light emitter, which can compromise the performance of heat sensitive electronics. Instead, the power and control components are typically arranged externally to the lighting fixture. Installation of solid state light emitters using several external power and control components can complicate the physical installation surrounding the lighting fixture and require added labor. Allowing several light emitters to share power and control components may reduce the number of components to install, but at the cost of surrendering individual power and control to each emitter. In particular, for large lighting installations where remote power control of many lighting fixtures is sought from a central location, maintaining individualized control capability is desirable for flexibility of the lighting system operation.

Designing a solid state lighting module with an AC voltage input can eliminate some of the external components, such as the DC driver. A solid state attenuator or rectifier may be used as a driver for the lighting element. For dimming control, passive control circuit devices (e.g., resistive/capacitive (RC) devices) can be used for dimming the lighting element by detection of the zero crossing points of the VAC input which can then be applied in phase-cut techniques. However, such control circuits are typically installed externally to the lighting fixture, and thus have the same drawback as with DC driven light emitters. In addition, due to minimum current flow requirements of the solid state attenuator, complete dimming may not be achievable. Typical circuits of this type are limited to dimming only down to about 5-10% of the light output before the light emitter simply cuts out because of the minimum current parameters of the attenuator. A dimming control circuit for solid state light emitters that can be contained within the lighting fixture with remote control network capability and that can allow deep dimming between 0 and 10% luminance is needed.

SUMMARY

In an aspect of the disclosure, a lighting module includes a light emitting diode (LED) array and a dimming circuit configured to control current applied to the LED array to control luminance of light emitted from the lighting module.

In another aspect of the disclosure, a lighting module includes an LED array arranged in a plurality of sections and a plurality of bypass circuits, each of the bypass circuits being configured to bypass a corresponding one of the sections of the LED array to control the luminance of light emitted from the lighting module.

In another aspect of the disclosure, a lighting module configured to be coupled to an external driver includes an LED array and a dimming circuit configured to control current applied to the LED array to control the luminance emitted from the lighting module. The dimming circuit includes a processor configured to receive a dimming input signal and to send a first control signal to an external driver and a second control signal to the dimming circuit in response to the dimming input signal.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

The word "exemplary" is used herein to mean serving as an example, instance, or illustration. Any embodiment described herein as "exemplary" is not necessarily to be construed as preferred or advantageous over other embodiments. Likewise, the term "embodiment" of an apparatus, method or article of manufacture does not require that all embodiments of the invention include the described components, structure, features, functionality, processes, advantages, benefits, or modes of operation. The phrase "coupled to" used herein relates to an electrical connection between two elements, and not necessarily a mechanical connection.

Figure 1:
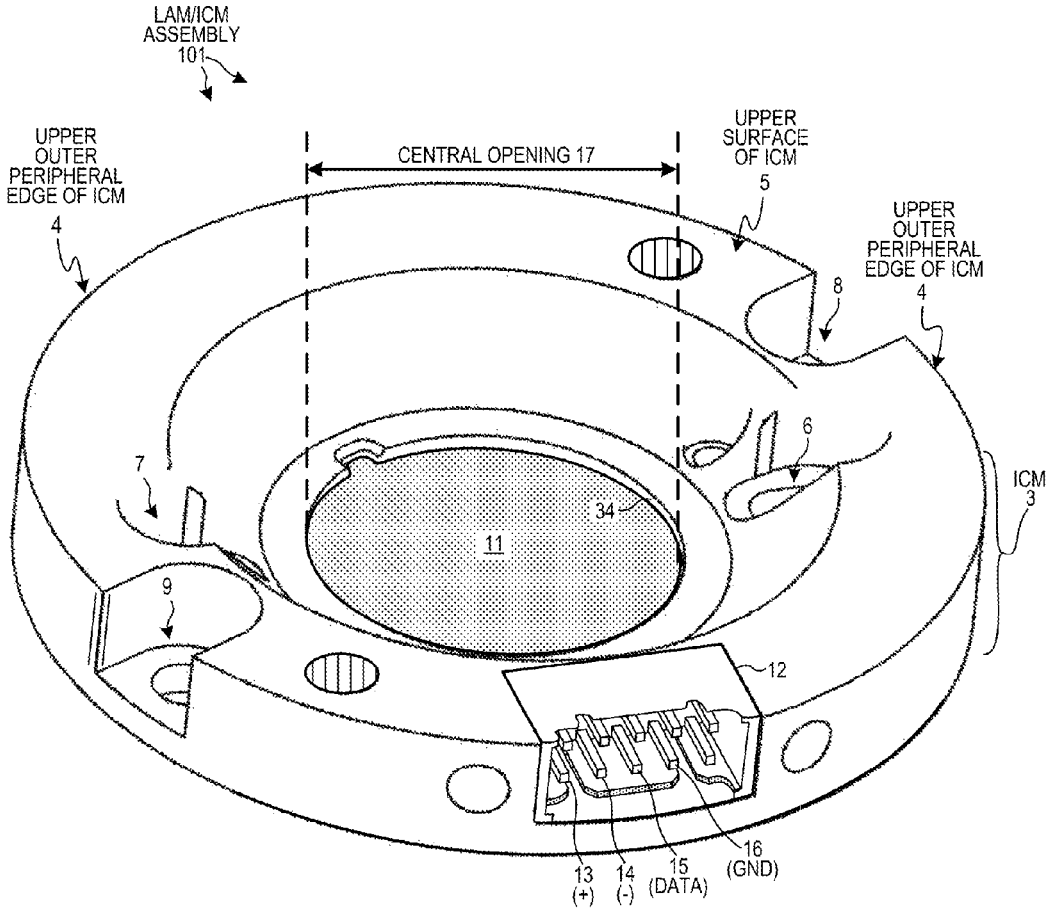
FIG. 1 is a perspective view of the connector side of the top of an exemplary LED array member (LAM)/integrated control module (ICM) assembly.
Figure 2:
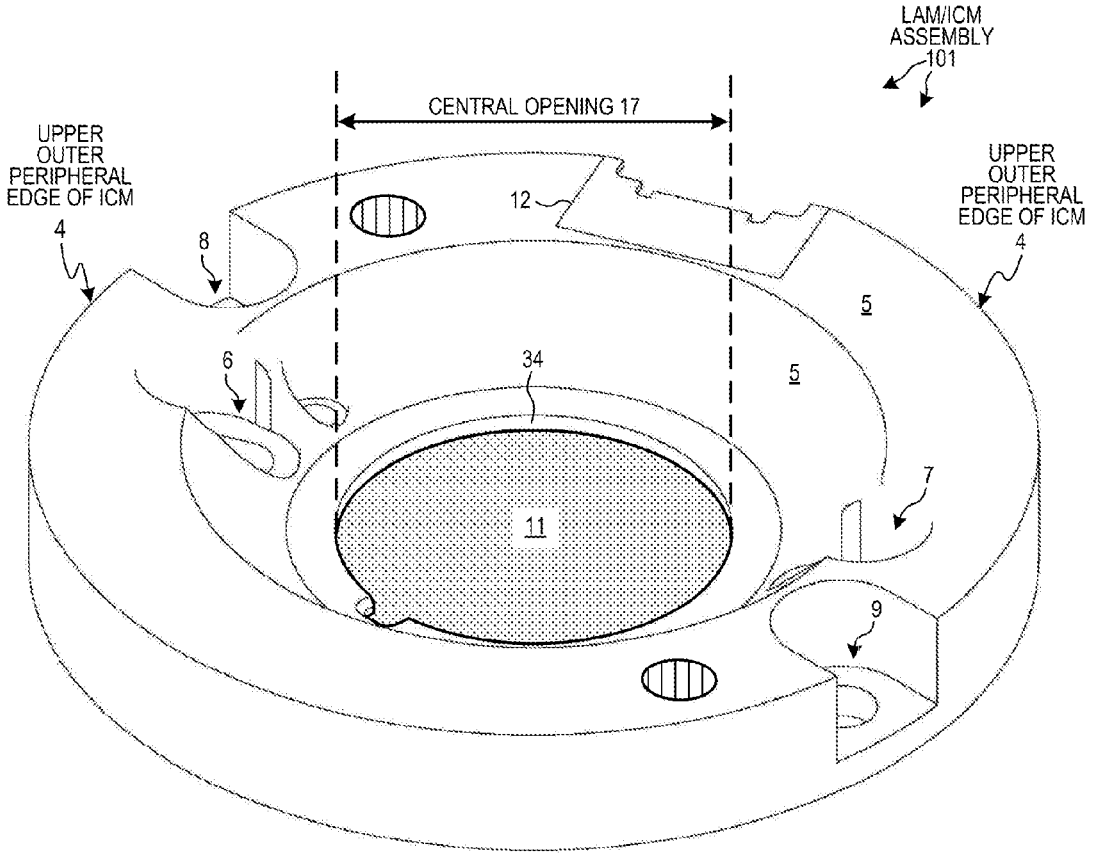
FIG. 2 is a perspective view of the top of an exemplary LED array member (LAM)/integrated control module (ICM) assembly from the side opposite the connector.

FIGS. 1-2 show perspective views of the top of an LED assembly member/integrated control module assembly (LAM/ICM assembly) 101. There are two parts of the LAM/ICM assembly: a LED assembly member 102 (FIG. 3) and an integrated control module 3. The LED assembly member 102 is hereinafter referred to as the LAM. The integrated control module 3 is hereinafter referred to as the ICM. As illustrated in the diagram, the LAM/ICM assembly 101 is a disk-shaped structure that has a circular upper outer peripheral edge 4.

Figure 6:
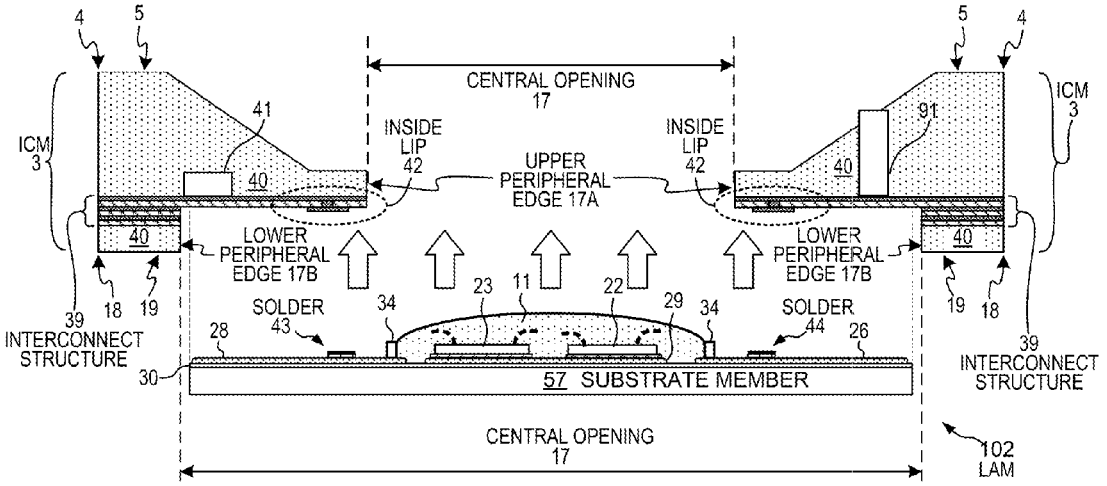
FIG. 6 is cross-sectional view showing how the exemplary LAM fits up and into the central opening in the ICM.

LAM/ICM assembly 101 includes an upper surface 5 of a molded plastic encapsulant 40 (FIG. 6). Two sets of two holes 6-9 are provided through which threaded screws or bolts (not shown) can extend to fix the LAM/ICM assembly 101 to a heat sink. The disk-shaped shaded object in the center in the illustration is a disk-shaped amount of silicone 11. The silicone 11 has phosphor particles embedded in it. This silicone with the embedded phosphor particles overlies an array of light emitting diodes (LEDs). The LEDs are not seen in the diagram because they are disposed under the silicone. The LAM/ICM assembly 101 further includes a header socket 12 and ten header pins, such as pins 13, 14, 15 and 16. Pin 13 is a power terminal through which a supply voltage or a supply current is received into the LAM/ICM assembly 101. Pin 14 is a power terminal through which the current returns and passes out of the LAM/ICM assembly. Pin 14 is a ground terminal with respect to the power terminal 13. Pin 15 is a data signal terminal through which digital signals are communicated into and/or out of the LAM/ICM assembly. Pin 16 is a signal ground for the data signals communicated on pin 15. The illustrated example of the LAM/ICM assembly 101 that has ten header pins is but one example. In other examples, fewer or more header pins are provided in the header socket 12, and assignment of power or signals to the pins can be on different positions than illustrated herein. If the LEDs underneath silicone 11 are powered and emitting light, then the light passes upward through the central circular opening 17 in upper surface 5, and is transmitted upward and away from the LAM/ICM assembly 101.

Figure 3:
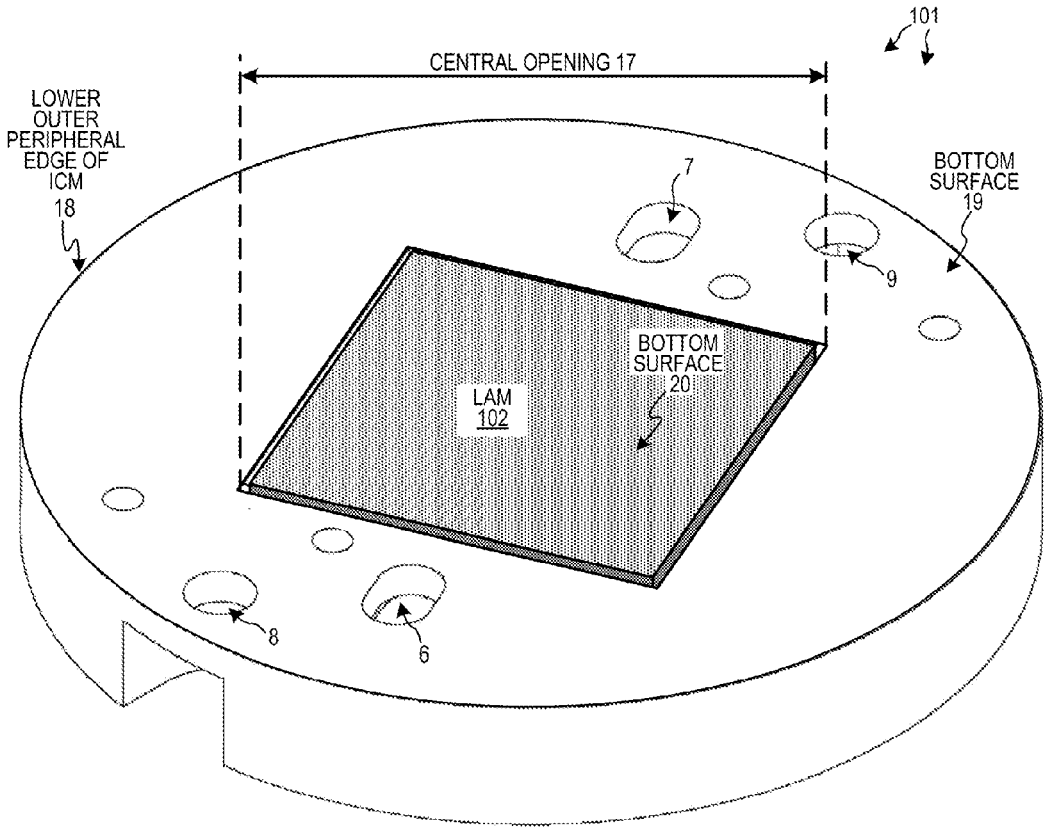
FIG. 3 is a perspective view of the bottom of the exemplary LAM/ICM of FIGS. 1 and 2.

FIG. 3 is a perspective view of the bottom of the LAM/ICM assembly 101, showing a circular lower outer peripheral edge 18 of the LAM ICM assembly 101. Whereas the shape of central opening 17 at the upper surface 5 of the ICM is circular as pictured in FIG. 1, the shape of the central opening 17 at the bottom surface 19 of the ICM as pictured in FIG. 3 is square. The LAM 102 is disposed in the central opening 17 so that the bottom surface 20 of the LAM 102 protrudes just slightly from the plane of the bottom surface 19 of the ICM 3. From the perspective of the illustration of FIG. 3, the bottom surface 20 of the LAM is slightly higher than is the bottom surface 19 of the ICM. The bottom surface 20 of the LAM is actually the bottom surface of a substrate member 57 of the LAM (FIG. 6).

Figure 4:
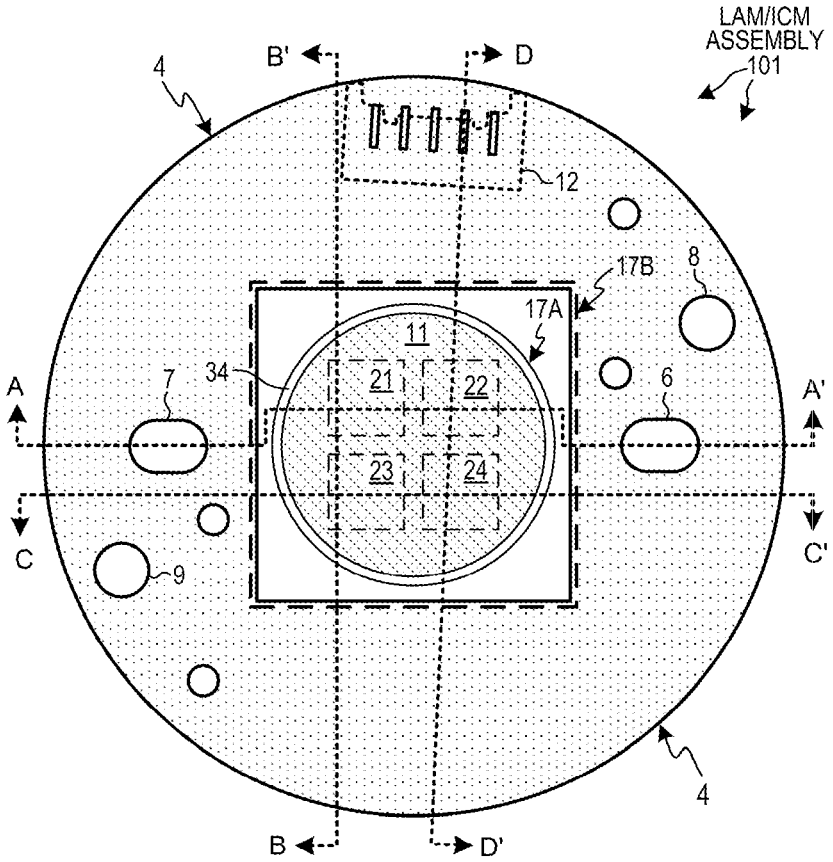
FIG. 4 is a cross-sectional, top-down view of the exemplary LAM/ICM assembly of FIGS. 1 and 2.

FIG. 4 is a cross-sectional, top-down diagram of the LAM/ICM assembly 101. The round circle identified by reference numeral 17A is the edge of circular central opening 17 at the upper surface of the ICM. The dashed square identified by reference numeral 17B is the edge of the square-shaped central opening 17 at the bottom surface of the ICM. The four dashed squares 21-24 identify where four LED dice are disposed underneath the silicone 11.

Figure 5:
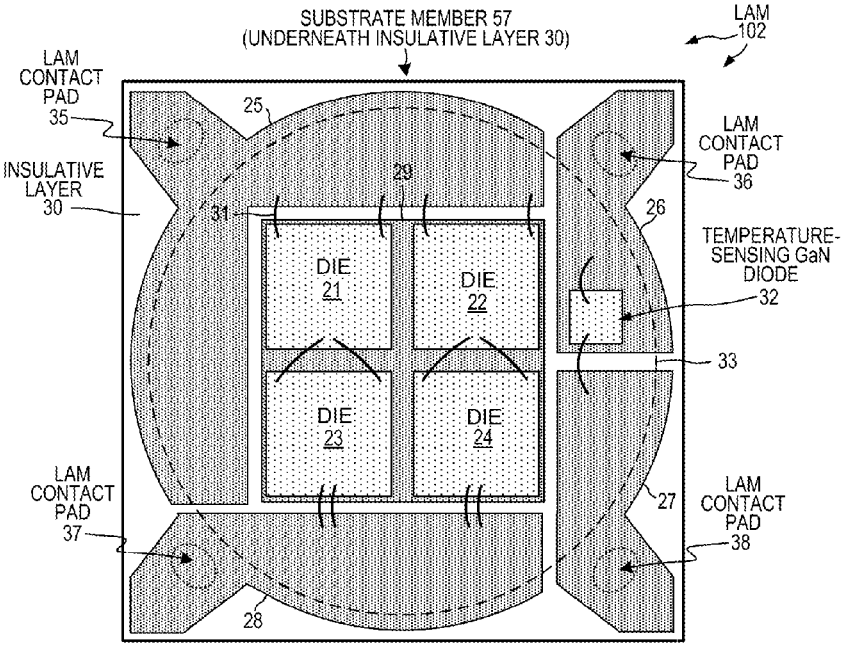
FIG. 5 is top-down view of an exemplary LAM usable with the ICM of FIGS. 1 and 2.

FIG. 5 is a simplified top-down diagram of one example of LAM 102, where the silicone and solder mask layers are not shown so that the metallization patterns of die attachment of LED dice 21-24 can be seen. There are five areas of metal 25-29 disposed on an insulative layer 30, where the insulative layer 30 in turn is disposed on the substrate member 57. The insulative layer 30 insulates each of the metal areas from the substrate member 57 of the LAM. The substrate member 57 in this case is a square piece of aluminum sheet. The four LED dice 21-24 are lateral LED dice that are die-attached to the central metal area 29. The LED dice are wire bonded to form two parallel strings. An LED drive current can flow through the first string by flowing from metal area 25, through LED die 21, through LED die 23, and to metal area 28. An LED drive current can flow through the second string by flowing from metal area 25, through LED die 22, through LED die 24, and to metal area 28. Reference numeral 31 identifies one of the bond wires. In addition to LED dice 21-24, LAM 102 includes a temperature sensing GaN diode die 32. In one example, this GaN diode die 32 is of identical construction to the LED dice. In the illustrated example, it is of identical construction except for the fact that it is a smaller die. The anode of GaN diode 32 is coupled via a bond wire to metal area 26. The cathode of GaN diode 32 is coupled via another bond wire to metal area 27. The dashed line 33 identifies the circular outer periphery of a rim 34 that retains the silicone 11. As can be seen from FIGS. 1, 2 and 4, this rim 34 is of a diameter that is just smaller than the inside diameter of the central opening 17 in the upper surface of the ICM. LAM contact pads 35-38 are shown as outwardly extending portions of the metal areas at the corners of the LAM 102. In this example, the LAM contact pads 35-38 have areas of metal that are exposed, and are not covered with soldermask.

FIG. 6 is a cross-sectional diagram that shows how the LAM 102 fits up into the central opening 17 in the ICM 3. ICM 3 includes an interconnect structure 39, a plurality of electronic components that are mounted to the interconnect structure, and the amount of insulative molded plastic encapsulant 40 that encases and encapsulates the interconnect structure 39 and one or more electronic components 41.

In the illustrated example, the interconnect structure 39 is a multi-layer printed circuit board (PCB). The entire printed circuit board may not be completely encapsulated. For example, the bottom of the inside lip 42 of the central opening 17 may be uncovered with encapsulant so that portions of metallization on this lip 42 can serve as ICM contact pads. Each of the LAM contact pads on the top of the LAM 102 is soldered to corresponding one of the ICM contact pads on the downward facing inside lip 42 of the ICM. In this example, amounts 43 and 44 of solder paste are disposed on the LAM contact pads, and the LAM 102 is moved up and into contact with the ICM 3, and then the assembly is heated in a reflow soldering process to solder the LAM contact pads to the ICM contact pads. Other soldering and mechanical/electrical interface methods such as conductive adhesives could be used instead of reflow soldering with solder paste as described herein.

Figure 7:
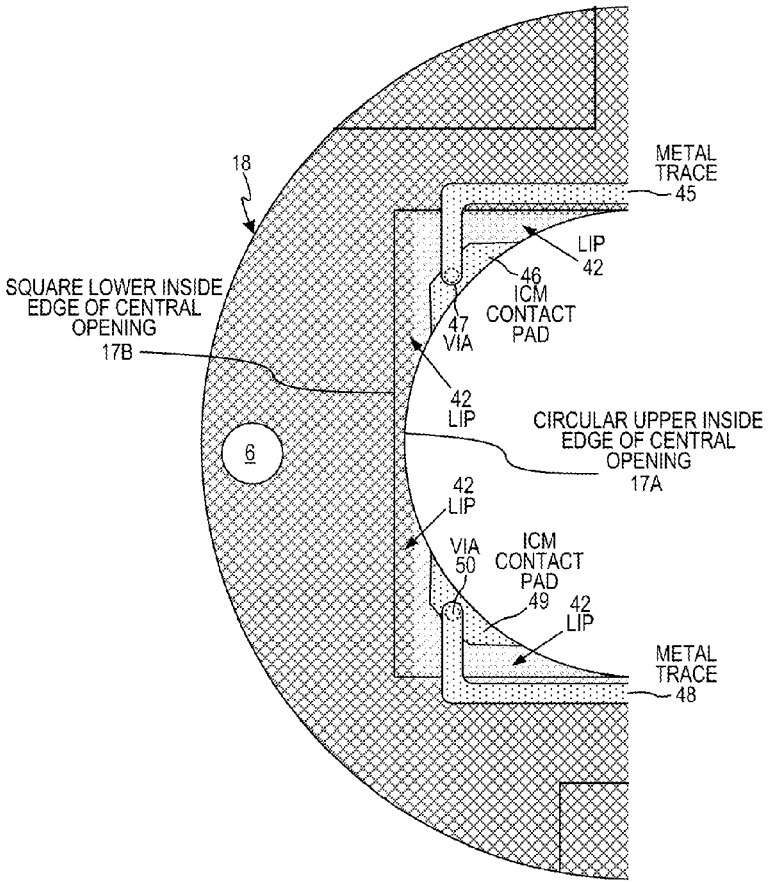
FIG. 7 is a diagram showing an exemplary ICM contact pad disposed on the inside lip of the ICM.

FIG. 7 is a view of the bottom of the ICM 3. Metal traces of the printed circuit board 39 extend to the inside lip 42 and connect to ICM contact pads through conductive vias. For example, trace 45 may contact ICM contact pad 46 through conductive via 47. Trace 48 may contact ICM contact pad 49 through conductive via 50.

Figure 8:
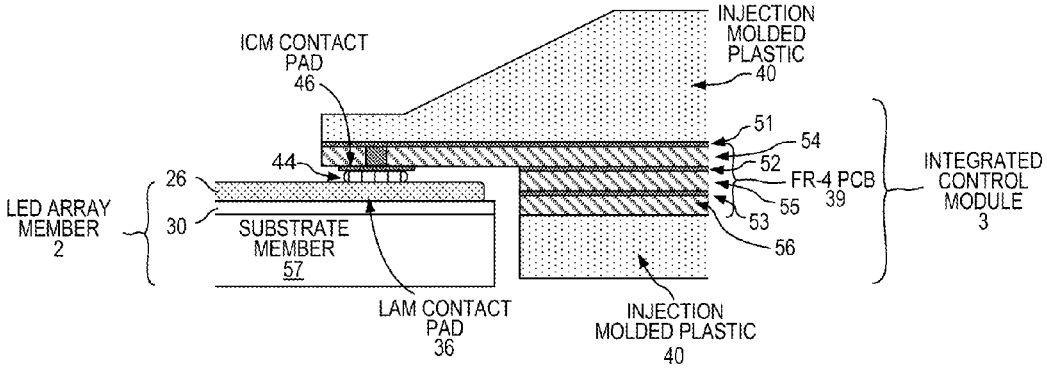
FIG. 8 is a more detailed diagram showing an exemplary LAM contact pad on the peripheral edge of upper surface of the LAM making contact with a corresponding ICM contact pad.

FIG. 8 is a view that shows how LAM contact pad 36 may be coupled via solder 44 to the corresponding ICM contact pad 46 on the inside lip of the ICM. The PCB 39 includes three metal layers 51, 52 and 53 and three fiberglass layers 54, 55 and 56. The substrate member 57 of the LAM 102 may be covered by insulative layer 30. The metal area 26, a part of which is LAM contact pad 36, may be electrically coupled to ICM contact pad 46, up through solder 44 and through a conductive via in the PCB, and to metal interconnect layer 51 of the PCB 39. The interconnect structure described herein is that of a conventional FR-4 PCB; however, other structures such as Kapton "flex circuit" or metal clad PCB circuits may also be used for this interconnect structure.

Figure 9:
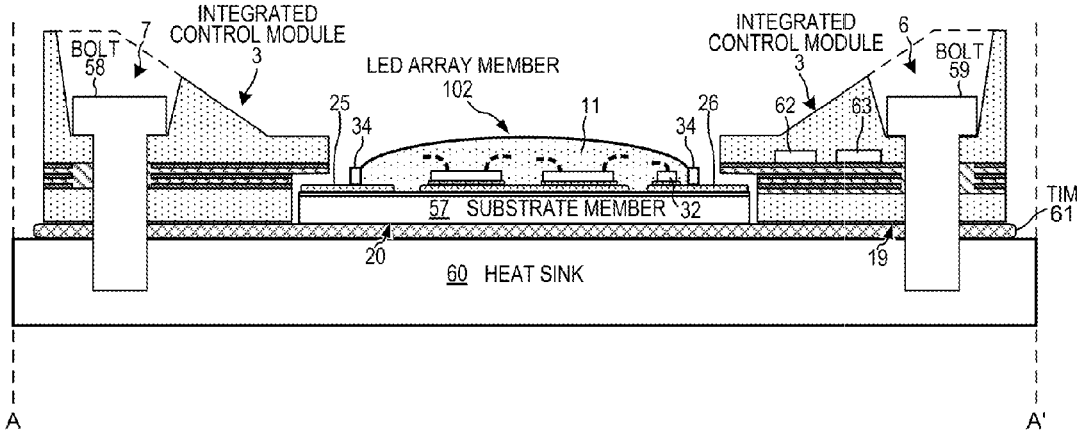
FIG. 9 is a cross-sectional view taken along line A-A' of the exemplary LAM/ICM of FIG. 4.

FIG. 9 is a cross-sectional view of the LAM/ICM assembly 101 of FIG. 4 taken along sectional line A-A' (shown on a heat sink 60). Bolts 58 and 59 extend through holes 6-7, and hold the bottom surface 20 of LAM 102 in good thermal contact with the heat sink 60 through a layer 61 of a thermal interface material (TIM). There are no LAM contact pads or ICM contact pads in the cross-section illustrated. Electronic components 62 and 63 of control circuitry are mounted on PCB 39. The circuitry may be overmolded by the injection molded plastic encapsulant 40.

Figure 10:
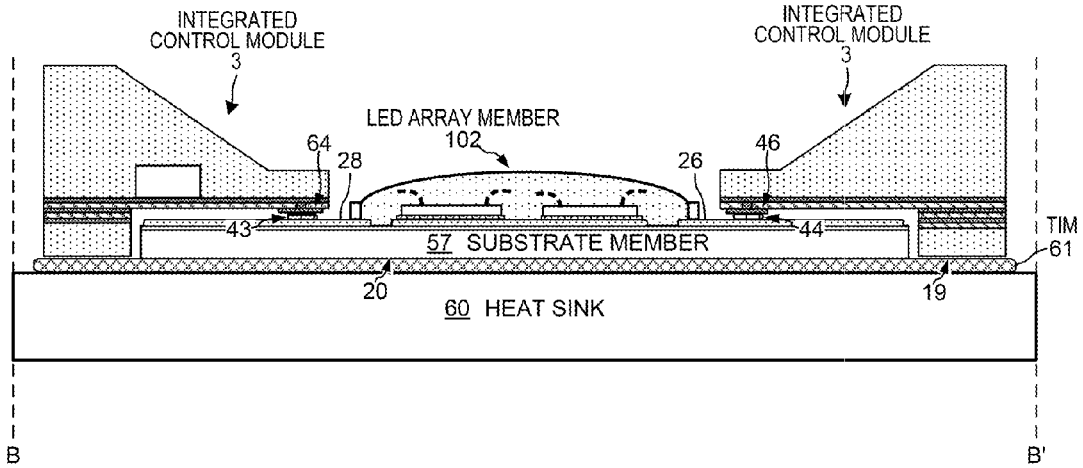
FIG. 10 is a cross-sectional view taken along line B-B' of the exemplary LAM/ICM of FIG. 4.

FIG. 10 is a cross-sectional view of the LAM/ICM assembly 101 of FIG. 4 taken along sectional line B-B' (shown on a heat sink). Solder 43 may electrically couple LAM contact pad 37 to ICM contact pad 64. Solder 44 may electrically couple LAM contact pad 36 to ICM contact pad 46.

Figure 11:
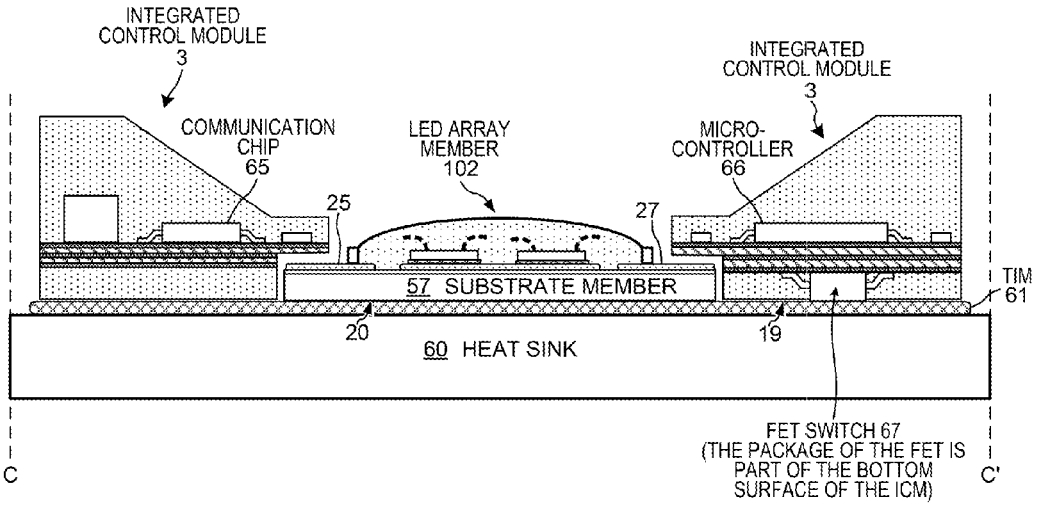
FIG. 11 is a cross-sectional view taken along line C-C' of the exemplary LAM/ICM of FIG. 4.

FIG. 11 is a cross-sectional view of the LAM/ICM assembly 101 of FIG. 4 taken along sectional line C-C' (shown on heat sink 60). Electronic components 65, 66 and 67 of a control circuit are mounted on PCB 39. Each of these three components 65-67 may be a packaged device that is in turn overmolded by the plastic encapsulant 40 of the ICM 3. In the case of component 67, a surface of the package forms a part of the bottom surface of the ICM 3 so that when the ICM 3 is pressed against the heat sink 60 (with the TIM 61 in between), the bottom surface of the packaged device makes good thermal contact with the heat sink 60. The component 67 may, for example, be a DCB-isolated SMPD (direct copper bonded isolated surface mount power device) package whose downward facing surface is a heat-dissipating substrate that is intended to be pressed against a heat sink.

Figure 12:
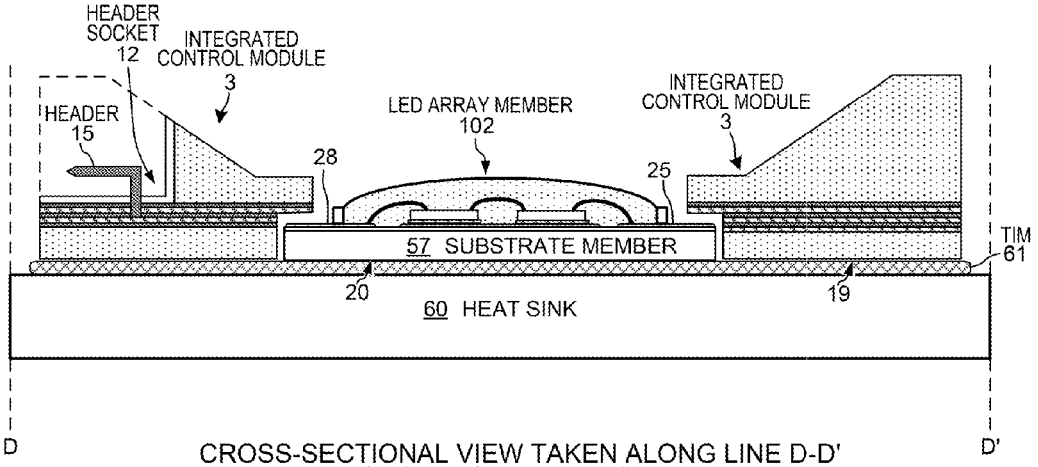
FIG. 12 is a cross-sectional view taken along line D-D' of the exemplary LAM/ICM of FIG. 4.

FIG. 12 is a cross-sectional view of the LAM/ICM assembly 101 of FIG. 4 taken along sectional line D-D' (shown on a heat sink).

The LAM/ICM assembly 101 may be implemented as a lighting module within a lighting system of multiple lighting modules that are interconnected. Each lighting module may be controllable for ON/OFF control, as well as dimming and monitoring of LED parameters (e.g., surface temperature) to maintain the lighting module within acceptable operating ranges to minimize aging and degradation and to optimize performance. For example, since each lighting module includes an ICM 3 having a processor 66 and communication unit 65, each lighting module may be individually controlled within the lighting system using a communication network.

Figure 13:
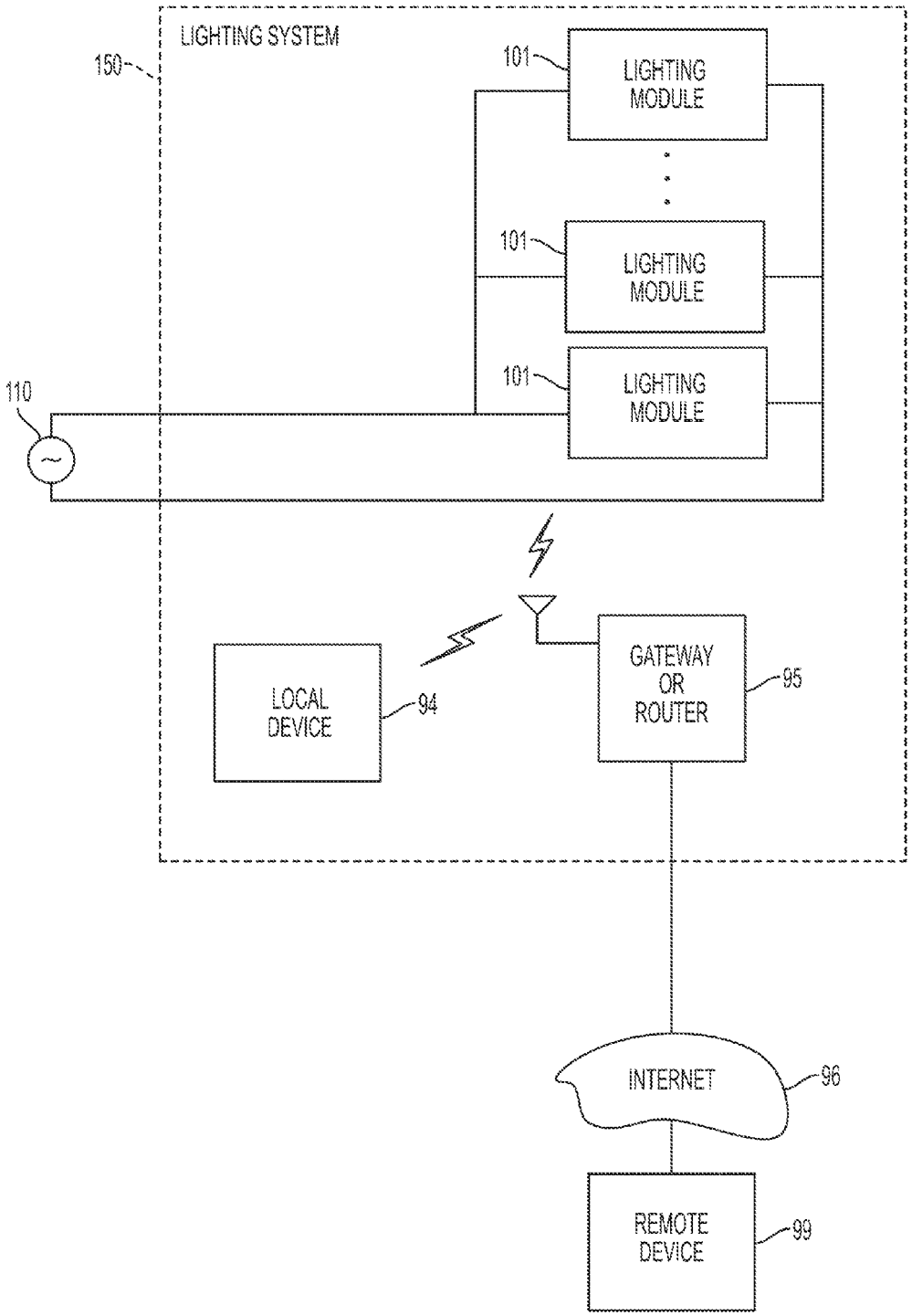
FIG. 13 shows a block diagram of an exemplary lighting system having remote dimming control of multiple lighting modules.

FIG. 13 shows a lighting system 150 that includes multiple lighting modules 101. Each lighting module 101 may implemented as the LAM/ICM assembly 1 as shown in FIGS. 1-12. A standard AC line voltage source 110 (e.g., 110 VAC) supplies the light emitter module 101. Power control, (i.e., ON/OFF switching) and dimming control to each lighting module 101 may be sent wirelessly via a control signal using antenna 98 of a gateway or router 95. In this example, the gateway or router 95 may receive a control signal from a remote device 99 over the Internet 96 for delivery to the gateway or router 95 via an Ethernet connection or some other suitable connection 97. Alternatively, a local device 94 may send a control signal directly to the gateway or router 95 via a wired or wireless local area network. Alternatively, the local device 94 may be hardwired to the gateway or router 95. This modular arrangement of lighting modules 101 allows a local device 94 or remote device 99 to control each lighting module 101 individually within the entire lighting system 150 from a single location or control point. Also, the modular configuration allows for easy expansion of the lighting system 150 as each lighting module 101 contains its own dimming control circuitry.

Figure 14:
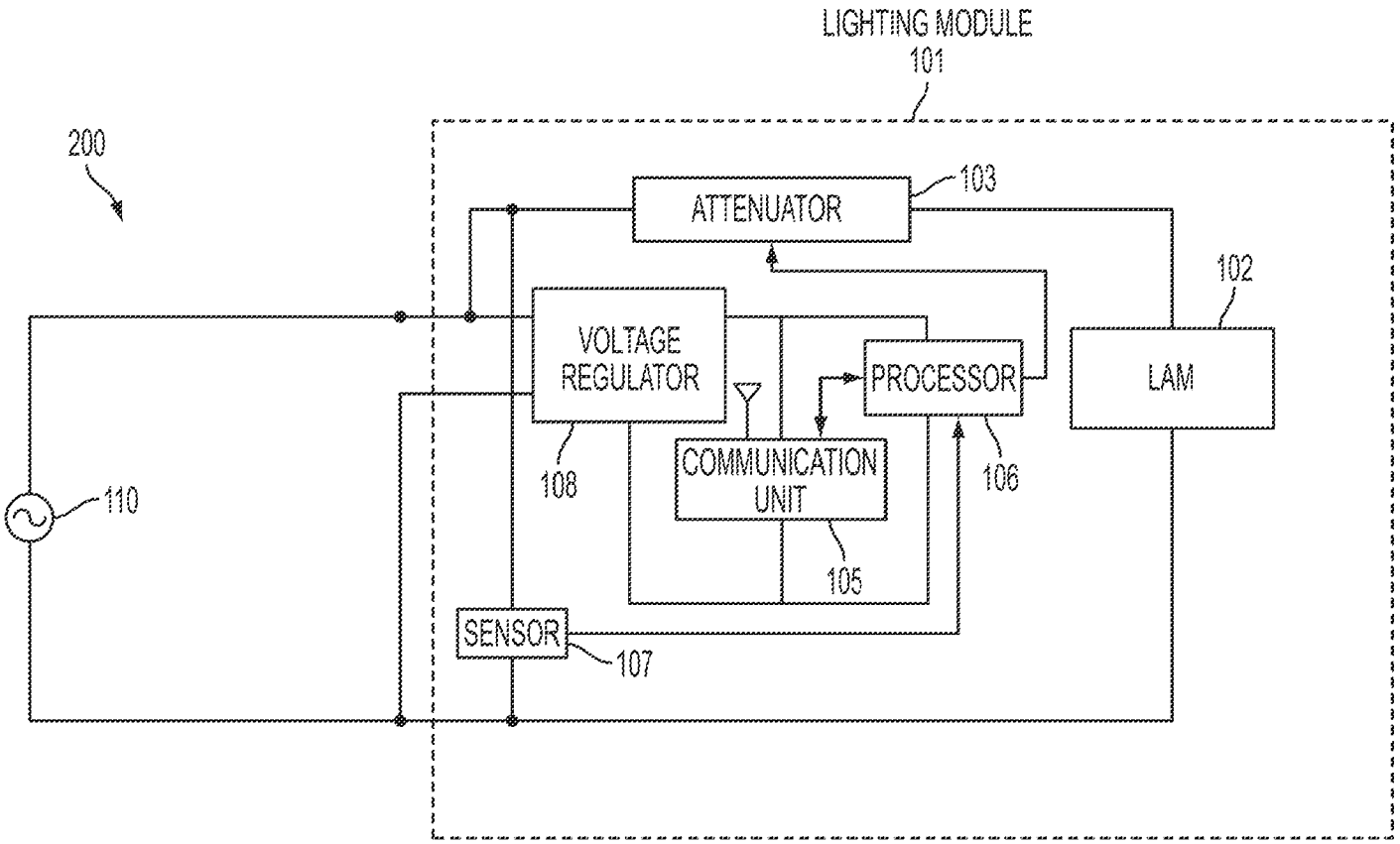
FIG. 14 shows a block diagram of an exemplary lighting module including a local dimming control circuit for a solid state light emitter.

FIG. 14 shows an exemplary power and dimming control circuit 200 for the lighting module 101. An attenuator 103 is connected between the AC power source 110 and the LAM 102 to attenuate the voltage applied to the LAM 102 between full voltage and 0 voltage for dimming functionality. A voltage regulator 108 is arranged to convert the AC voltage to a DC voltage (e.g., 110VAC/3VDC) for the dimming control circuit contained internally within the lighting module 101, which includes a communication unit 105 and a processor 106.

The communication unit 105 is configured to receive a remote wireless control signal from the local device 94 or the remote device 99 (see FIG. 13). The processor 106 is configured to control the attenuator 103 by sending a dimming control signal based on the remote control signal. The attenuator 103 may be configured as a phase cutting device that can be switched in a modulated manner to phase-cut the sinusoidal AC voltage to the LAM 102, which controls the luminance of the light output of the LAM 102 in response to the dimming control signal from the processor 106. For example, the attenuator 103 may be configured as a triac. As another example, the attenuator 103 may be configured as a phase cutting transistor.

The processor 106 may monitor the zero crossing points of the AC voltage via sensor 107, and execute an algorithm to determine a phase angle for the phase cut to achieve the desired dimming level. The processor 106 may then send the dimming control signal to trigger the attenuator 103 according to the phase cut. By triggering the attenuator 103 at some phase angle greater than the zero crossing point, a fraction of the supply voltage sinusoidal wave is supplied to the LAM 102, which provides the desired dimming effect.

In the example of the dimming control circuit 200 implemented within the ICM 3 shown in FIGS. 1-12, the attenuator 103 may be arranged on the PCB 39 as component 67, the processor 106 may be arranged on the PCB 39 as component 66, and the communication unit 105 may be arranged as component 65 on the PCB 39 as shown in FIG. 11.

Figure 14A:
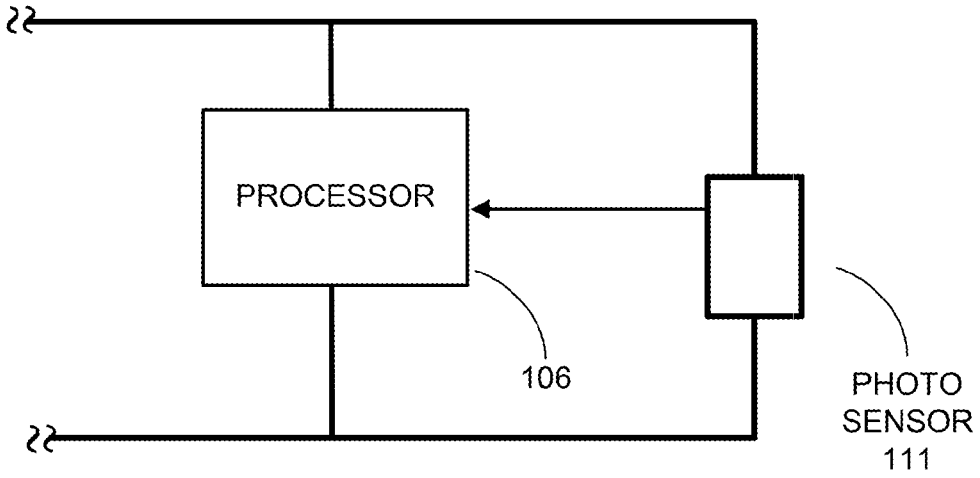
FIG. 14A shows an example of a photo sensor used to detect ambient luminance for controlling dimming of a solid state light emitter.

FIG. 14A shows an optional photo sensor 111 that senses ambient light and provides feedback to the processor 106, which may control dimming based on ambient light conditions and settings according to user preference. In some embodiments, the photo sensor 111 may measure the ambient luminance at the sensor location and provide that information to the processor 106. The processor 106 may use the information to adjust the luminance of the light output from the LAM 102 by adjusting the power being delivered to the light source at the attenuator 103.

The photo sensor 111 may be arranged on the PCB as device 91 as shown in FIG. 6. Alternatively, the photo sensor 111 may be disposed separate from the lighting module 101. Alternatively the photo sensor 111 may be disposed in a different part of a room and configured to communicate the information regarding ambient lighting at that part of the room back to the processor 106. In this example, the photo sensor 111 may be local devices 94 which may communicate either directly with processor 106 or indirectly with processor 106 via gateway or router 95. The processor 106 may control the light output of the LAM 102 by using the information received from the sensor to determine the ambient light in the room and either increase or decrease the power being delivered to the light source depending on determined ambient light. For example, if the processor 106 determines that the luminance of light in the room is lower than a predetermined level, then the power to the LAM 102 may be increased by adjustment to the attenuator 103. Similarly, if the processor 106 determines from the information received from the sensor that the luminance of light in the room is higher than a predetermined level, then the power to the LAM 102 may be decreased.

The predetermined level of light in the room may be set by a user and include factors such as a predetermined level based on day of week or time of day. The predetermined level of light in the room may also be adjusted based on factors such as occupancy input. For example, a motion sensor may provide information to the processor 106 that the room has a person in it, then the predetermined level may be adjusted accordingly. The predetermined level may also be adjusted based on inputs such as whether the television is ON or OFF. For example if the television is ON, the predetermined level may be lower than when the television is OFF. In one embodiment, the predetermined level of luminance in the room when the television is ON may be set to 75% lower than when the television is OFF.

In another embodiment, the photo sensor 111 may be configured to determine a sudden change in ambient luminance (e.g., when the blinds in a room are opened). Here, the predetermined level may be set to very low or zero. If the predetermined level is set to zero when the blinds are determined to be open, then the processor 106 may control the attenuator 103 to dim the LAM 102 to zero.

Figure 15:
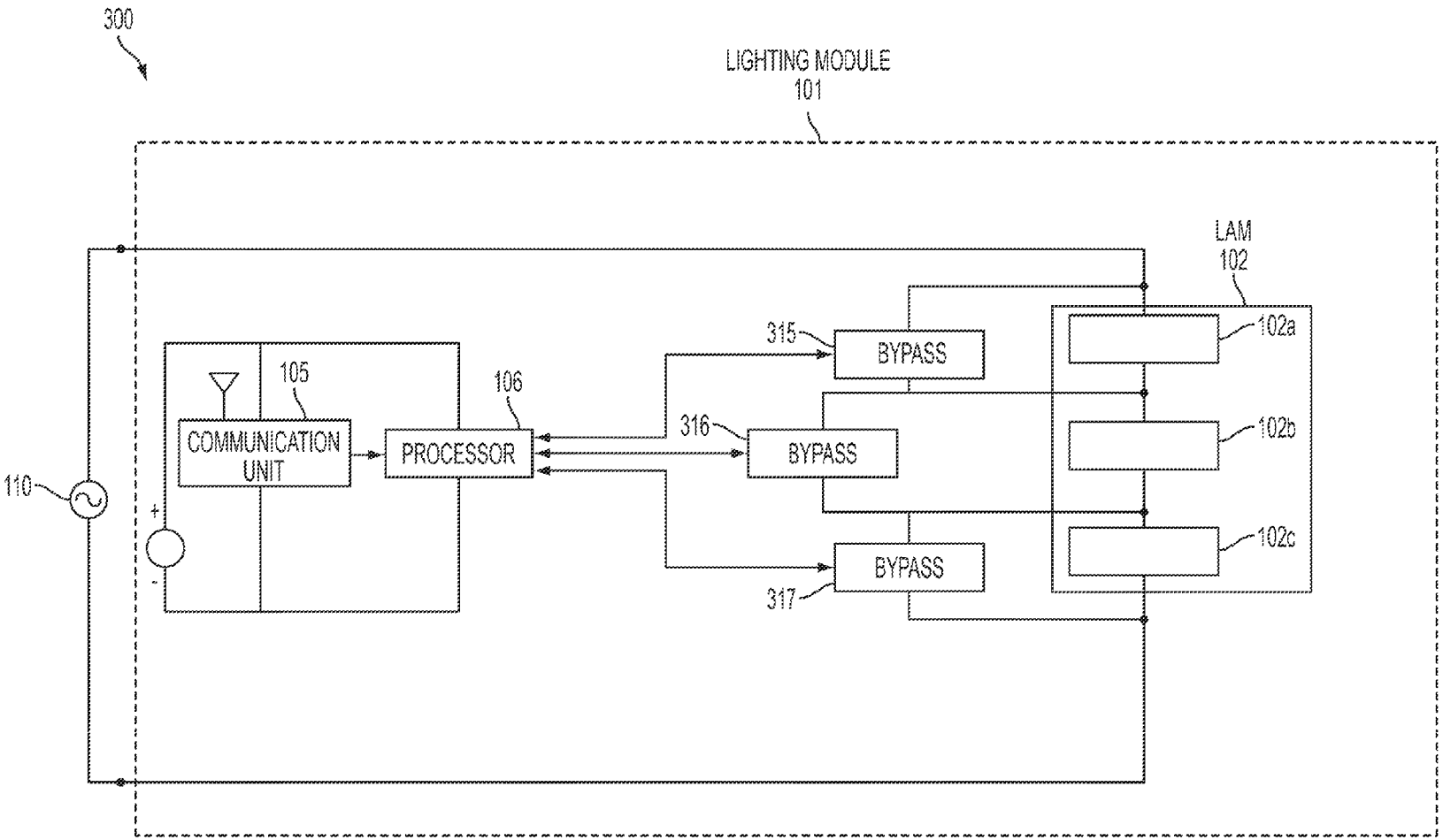
FIG. 15 shows a block diagram of an exemplary lighting module including a local dimming control circuit for LED array sections.

FIG. 15 shows an exemplary power and dimming control circuit 300 for the lighting module 101 to control the LAM 102. In this example, the LAM 102 is arranged having multiple LED sections 102*a*, 102*b*, 102*c*. The LAM 102 may include more or less than three LED sections. Each LED section 102*a*, 102*b*, 102*c* may include one or more LEDs, LED pairs, or strings of LEDs, LED pairs. LED pairs may be connected in parallel with opposite polarity to allow AC supply current to drive each LED in an alternating pattern. Likewise, LED strings may be connected in parallel pairs with opposite polarity. For multiple strings of LEDs, each string may be connected in series, in parallel, or combinations of both. Alternatively, the LEDs of LED sections 102*a*, 102*b*, 102*c* may be arranged for DC operation, such as in series for example. To drive the LEDs for DC operation, a full wave bridge rectifier may be included in the control circuit to convert the AC voltage from supply 110 to a DC voltage.

A processor 106 may be programmed with software to steer the current to each LED section, or around each LED section of LAM 102. For example, to control dimming of the LAM 102, one or more LED sections may be shunted in a controlled manner to achieve the desired dimming. As shown in FIG. 15, bypass circuits 315, 316, and 317 shunt the LED sections 102*a*, 102*b*, and 102*c* respectively.

In one embodiment, each bypass circuit 315, 316, and 317 includes a field effect transistor (FET) having the gate voltage controlled by the processor 106 to switch the FET on, so that the processor 106 controls current steering away from the shunted LED section. For example, bypass circuit 315 may operate a FET in an energized state, which completely diverts the current through the FET and bypasses LED section 102*a*. The bypass circuits 316 and 317 may maintain the FET in a deenergized state and effectively an open switch, allowing the LED sections 102*b* and 102*c* to receive full current. The luminance level of LAM 102 is then dimmer by approximately one third.

The processor 106 may also control the gate voltage of the FET to operate in a linear mode which provides a shunt resistance to the respective light emitter. For example, the FET in bypass circuit 315 may have its gate voltage controlled by processor 106 within a range to operate the FET in linear mode, so that drain to source current is controlled in a way to divert some current away from the light emitter. The FET may operate effectively as a variable resistor in this linear mode, and the LED section 102*a* may be dimmed according to the current steering. Alternatively, the bypass circuits 315, 316, 317 may include variable resistors controlled by the processor 106 to variably shunt the LED sections 102*a*, 102*b*, 102*c*.

In one example, the processor 106 may execute a software program that can control dimming of the LAM 102 according to one or more dimming curves to dim faster or slower, which may be adapted to user preference. The dimming curves may include linear and logarithmic profiles to expand dimming of the light emitters across the full range of a controller for fuller resolution. For example, a dimming controller in the local device 94 or the remote device 99 (see FIG. 13) with a luminance level range 1 to 10 can operate the LAM 102 with a sliding scale of luminance levels for even and proportional dimming at each discrete level within the full range. In contrast, conventional dimming controllers may affect the dimming only within a subrange, such as between settings 3 and 8, effectively half of the available resolution for the full range 1 to 10.

In another example, the processor 106 may be programmed to control the color temperature of the LAM 102 during dimming. This may be implemented by steering current using the bypass circuits 315, 316, 317 to each LED section according to the color characteristics of the LEDs (e.g., depending on the phosphors of the LED). For example, if LED section 102*a* is configured to emit red light, and the LED sections 102*b* and 102*c* emit blue or green light, the processor 106 may steer the current away from the LED sections 102*b* and 102*c* to achieve warmer color effect, predominantly from the red LED section 102*a*.

Each of the bypass circuits 315, 316, 317 may include a sensor to detect the amount of current being diverted from each respective LAM section 102*a*, 102*b*, 102*c* so that the processor 106 can selectively adjust dimming control and the current steering according to the methods described above.

Figure 16:
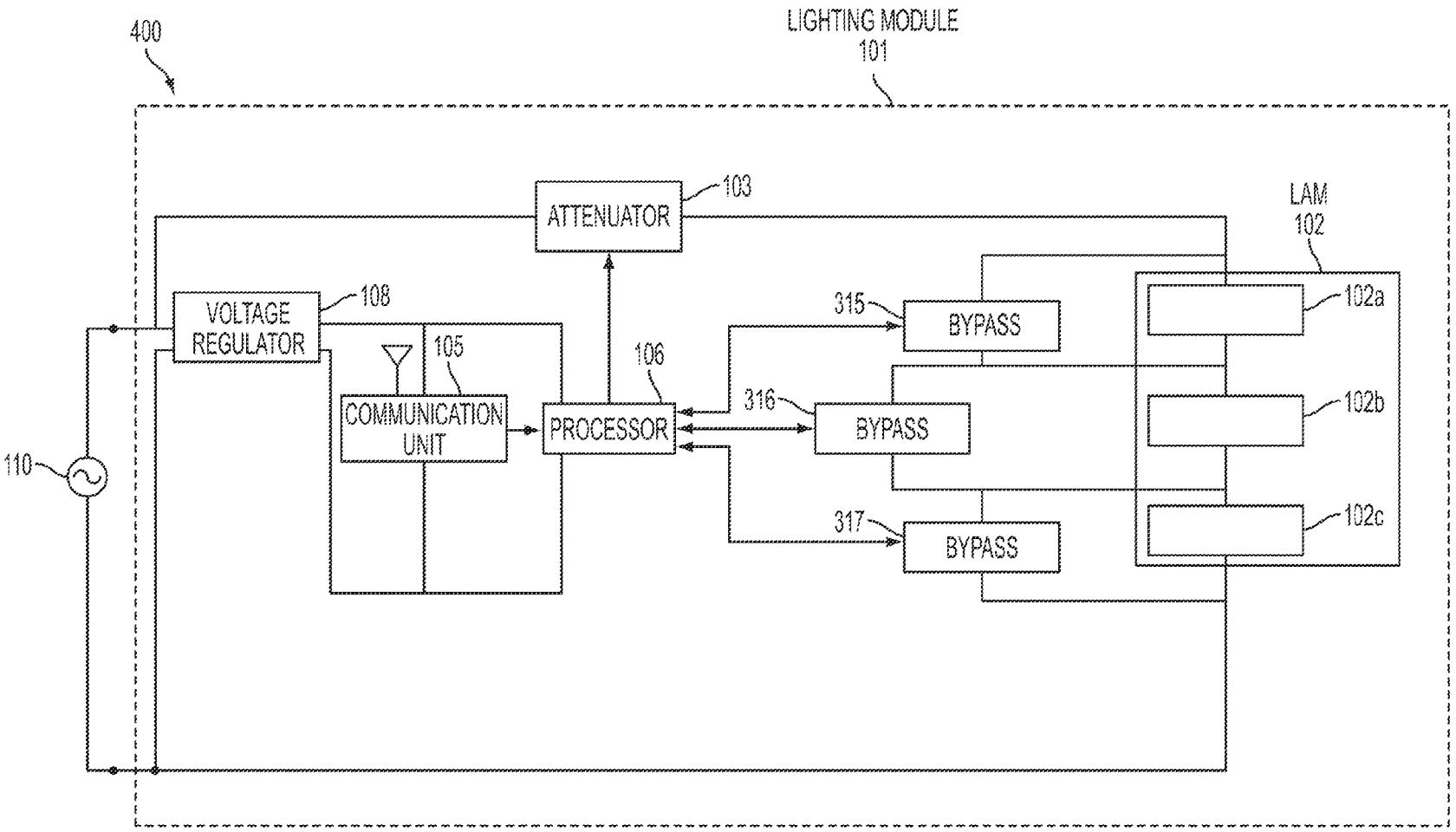
FIG. 16 shows block diagram of an exemplary lighting module including a local dimming control circuit for multiple solid state light emitters combining primary dimming control and deep dimming control.

FIG. 16 shows an exemplary dimming control circuit 400 for the lighting module 101 to control triggering of the attenuator 103 and to control a plurality of LED sections 102*a*, 102*b*, 102*c*. The processor 106 is configured to receive a dimming input signal from the receiver 105 and to send a control signal to the attenuator 103 to dim the light emitters 102*a*, 102*b*, 102*c*. In this example, the attenuator 103 may be controlled to reduce the luminance by phase cutting as described above with respect to FIG. 14. For an embodiment in which the attenuator 103 is implemented as a triac, the dimming control may be limited to between 100% luminance and about 5-10% luminance due to minimum current parameters to operate the triac. To complete the dimming control for full dimming down to 0% luminance, the processor 106 may be configured to send deep dimming control signals to bypass circuits 315, 316 and 317 for shunting the light emitters 102*a*, 102*b* and 102*c* respectively. Because the attenuator 103 may significantly reduce the operating current of the light emitter array 102 to a low level (i.e., near 5-10% of the full current), the heat dissipation by the bypass circuits 315, 316, 317 is limited to low levels during deep dimming, which allows the dimming control circuit 400 to be contained locally within the light emitter module 101. In alternative variations, the processor 106 may be programmed to control the attenuator 103 for a different dimming control range, for example between 100% and 30% luminance, and to control the bypass circuits 315, 316, 317 for the reminder dimming control range between 0% and 29% luminance. The dimming control circuit 400 is not limited to these combined dimming ranges, as the processor 106 may combine other ranges according to the operation parameters of the attenuator 103 and the bypass circuits 315, 316, and 317.

Figure 17:
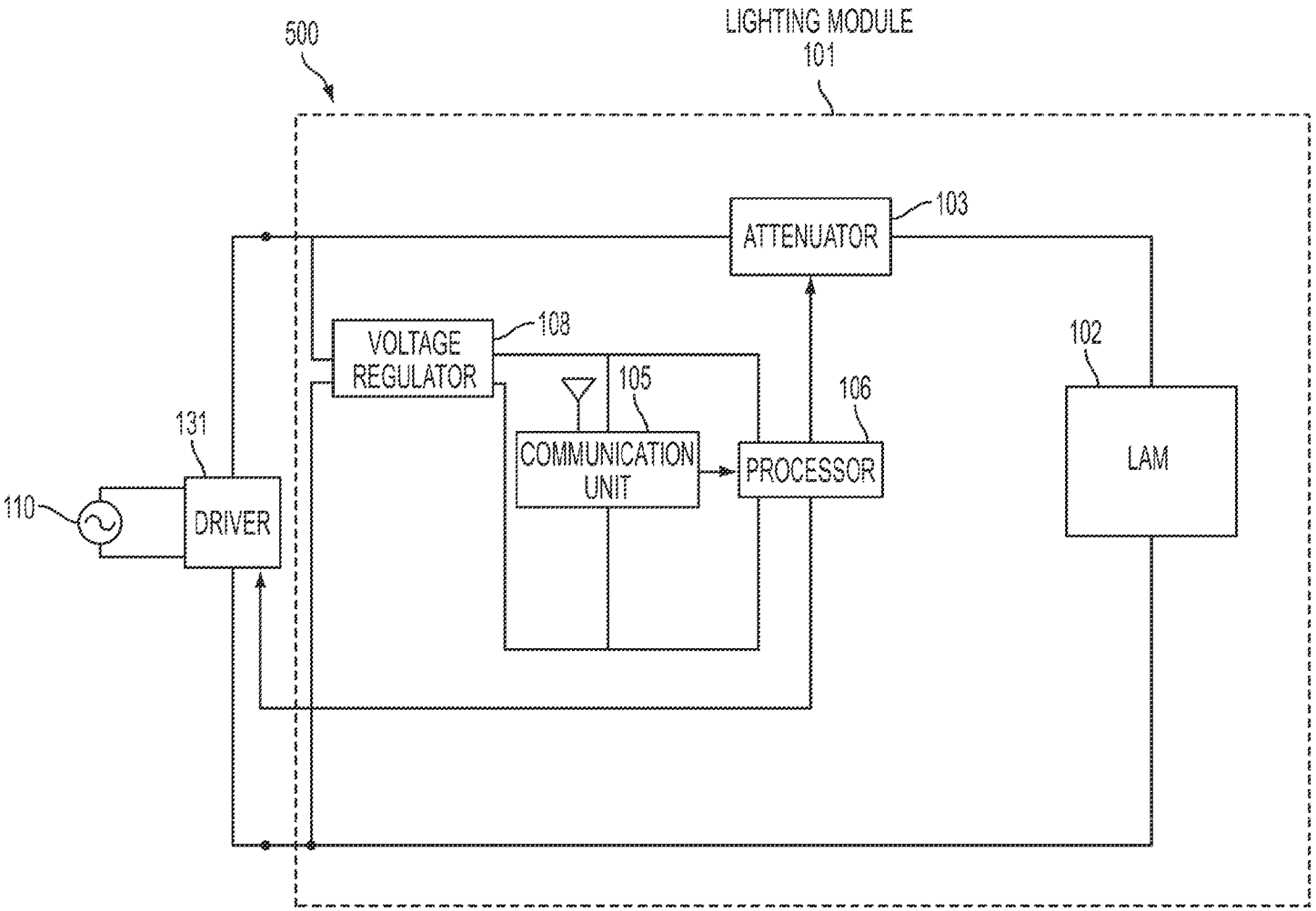
FIG. 17 shows a block diagram of an exemplary lighting module including a local dimming control circuit for deep dimming of multiple solid state light emitters powered by a DC driver.

FIG. 17 shows an exemplary dimming control circuit 500 to control dimming of an LAM 102. In this example, an external constant current DC driver 131 is powered by the AC power source 110. The processor 106 may perform a primary dimming control of the LAM 102 by sending a dimming control signal back to the driver 131 to increase and to decrease the magnitude of the constant current being output by the driver 131. However, the driver 131 may only be controlled to a level of current that dims the LAM 102 down to about 10% of luminance. To achieve deep dimming, the processor 106 may send a control signal to an attenuator 103 in series with the LAM 102 to provide a variable resistance. For example, the attenuator 103 may be configured as a field effect transistor (FET), controlled by the processor 106 to operate in a linear mode. The processor 106 may control the attenuator 103 to fine tune the amount of current supplied to LAM 102 by adjusting the voltage drop across the FET in linear mode to an amount required to achieve the necessary current flow. Alternatively, the attenuator 103 may be configured as a variable resistor controllable by the processor 106.

As shown in FIG. 17, the attenuator 103 is coupled to the LAM 102 in series. In an alternative example, the attenuator 103 may be coupled to the LAM 102 in parallel to variably shunt the current to the LAM 102 to achieve the deep dimming control in response to the control signal from the processor 106. The LAM 102 may be configured as multiple LED sections as shown in FIG. 15 and FIG. 16, with an attenuator 103 arranged in series or in parallel with each LED section to achieve the deep dimming.

The optional photo sensor 111 shown in FIG. 14A may be combined with any of the above embodiments, such as shown in FIGS. 14-17 and described above.

With respect to the processor 106, examples of processors include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described throughout this disclosure. The processor may execute software. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Aspects may also be implemented using a combination of both hardware and software. Accordingly, in one or more example aspects, the functions described may be implemented in hardware, software, firmware, or any combination thereof, depending upon the particular application and design constraints imposed on the overall system.

While aspects have been described in conjunction with the example implementations outlined above, various alternatives, modifications, variations, improvements, and/or substantial equivalents, whether known or that are or may be presently unforeseen, may become apparent to those having at least ordinary skill in the art. Accordingly, the example implementations of the invention, as set forth above, are intended to be illustrative, not limiting. Various changes may be made without departing from the spirit and scope of the aspects. Therefore, the aspects are intended to embrace all known or later-developed alternatives, modifications, variations, improvements, and/or substantial equivalents.

Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under 35 USC 112(f) unless the element is expressly recited using the phrase "means for" or "step for."

What is claimed is:

1. A lighting module comprising:

a light emitting diode (LED) array; and a dimming circuit configured to control current applied to the LED array to control luminance of light emitted from the lighting module, the dimming circuit comprising:

a triac configured to provide current from an AC power source to the LED array; and a processor configured to:

determine a phase angle for phase cutting the triac;

send a control signal to trigger a switching operation of the triac based on the phase angle;

monitor zero crossing points for the AC voltage input; and determine the phase angle based on the zero crossing points.

2. The lighting module of claim 1, wherein the lighting module is configured to be connected to an AC power source.

3. The lighting module of claim 1, wherein the processor is further configured to receive a dimming input signal and to provide a control signal to the dimming circuit in response to the dimming input signal.

4. The lighting module of claim 3 wherein information associated with ambient luminance is provided to the processor.

5. The lighting module of claim 4 wherein the processor determines the luminance, compares the determined luminance with a predetermined level, and determines the control signal for dimming based on the comparison.

6. The lighting module of claim 5 wherein the predetermined level is based on the day of week or time of day or both.

7. The lighting module of claim 5 wherein the predetermined level is based on information received by the processor that a television is ON based on detected ambient luminance.

8. The lighting module of claim 1, further comprising a bypass circuit arranged with the LED array, wherein the processor is configured to provide a bypass control signal to the bypass circuit for current steering to the LED array to control the luminance of light emitted from the lighting module.

9. The lighting module of claim 8, wherein the bypass circuit comprises a plurality of variable resistors, with at least one resistor being arranged to shunt a corresponding one of the LEDs and to variably divert an amount of current from the corresponding one of the light emitters based on the control signal.

10. The lighting module of claim 1, wherein the dimming circuit further comprises a sensor configured to determine the zero crossing points for the AC voltage input and to send zero crossing point information to the processor.

11. The lighting module of claim 1, wherein the dimming circuit further comprises:

a communication unit configured to receive the dimming input signal wirelessly and to provide the dimming input signal to the processor.

12. The lighting module of claim 8, wherein the bypass circuit comprises a plurality of transistors, with at least one transistor being arranged to shunt a corresponding one of the LEDs.

13. The lighting module of claim 8, wherein at least a first portion of the LED array is configured to emit a first light color and at least a second portion of the LED array is configured to emit a second light color different that the first light color, and wherein the processor is further configured to provide a bypass control signal to control color temperature of the light emitted from the lighting module.

14. A lighting module configured to be coupled to an external driver, comprising:

a LED array; and a dimming circuit configured to control current applied to the LED array to control luminance emitted from the lighting module, the dimming circuit comprising:

a processor configured to receive a dimming input signal and to send a first control signal to an external driver and a second control signal to the dimming circuit in response to the dimming input signal.

15. The lighting module of claim 14, a dimming circuit, wherein the dimming circuit further comprises:

a communication unit configured to receive the dimming input signal wirelessly and to provide the dimming input signal to a processor.

16. The lighting module of claim 14, wherein the dimming circuit further comprises an attenuator configured to receive constant current from the driver and the processor is further configured to determine a variable resistance for the attenuator, and wherein the second control signal controls the variable resistance.

17. The lighting module of claim 14, wherein the dimming circuit further comprises:

a communication unit configured to receive the dimming input signal wirelessly and to provide the dimming input signal to the processor.

* * * * *